US006682632B2

(12) United States Patent
Nikulainen et al.

(10) Patent No.: US 6,682,632 B2
(45) **Date of Patent: *Jan. 27, 2004**

(54) ROLL FOR A PAPER OR BOARD MACHINE

(75) Inventors: Osmo Nikulainen, Muurame (FI); Heikki Karttunen, Jyväskylä (FI); Antti Leinonen, Laukaa (FI); Seppo Kiviranta, Jyväskylä (FI); Hannu Villgrén, Jyväskylä (FI); Miikka Kettunen, Croyden (GB); Samppa Salminen, Jyväskylä (FI); Mika Viertola, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 25 days.

This patent is subject to a terminal disclaimer.

(21) Appl. No.: 10/166,159

(22) Filed: Jun. 10, 2002

(65) Prior Publication Data

US 2003/0008757 A1 Jan. 9, 2003

Related U.S. Application Data

(63) Continuation of application No. 09/581,279, filed as application No. PCT/FI98/00943 on Dec. 3, 1998, now Pat. No. 6,402,896.

(30) Foreign Application Priority Data

Dec. 10, 1997 (FI) ..... 974480

(51) Int. Cl.[7] ..... D21F 3/10

(52) U.S. Cl. ..... 162/368; 162/363; 162/367; 162/370; 162/372; 162/217; 29/121.3; 29/121.1; 100/118; 100/121

(58) Field of Search ..... 162/368, 363, 162/367, 370, 372, 217; 29/121.3, 121.1; 100/118, 121

(56) References Cited

U.S. PATENT DOCUMENTS 1,805,780 A * 5/1931 Millspaugh
4,366,025 A * 12/1982 Gordon et al. ..... 162/358
5,135,614 A * 8/1992 Aula et al. ..... 162/217

* cited by examiner

*Primary Examiner*—Steven P. Griffin
*Assistant Examiner*—M. Halpern
(74) *Attorney, Agent, or Firm*—Steinberg & Raskin, P.C.

(57) ABSTRACT

The invention relates to a roll for a paper or board machine comprising axle journals on whose support the roll is arranged to revolve, end flanges with which the axle journals are connected, and a mantle which is connected with the end flanges. The mantle is provided with a number of openings extending through the mantle and/or recesses formed into the outer surface of the mantle, which openings and/or recesses form a regular pattern. Solid connecting portions in the outer surface of the mantle around said openings and/or recesses are opened so that, from each opening and/or recess, there is a connection, provided in the form of a groove or an additional recess extending into the outer surface of the roll mantle, with at least each of the openings and/or recesses adjacent to it.

11 Claims, 4 Drawing Sheets

ROLL FOR A PAPER OR BOARD MACHINE

CROSS REFERENCE TO RELATED APPLICATION—

This application is a continuation of U.S. patent application Ser. No. 09/581,279 filed Jun. 9, 2000, now U.S. Pat. No. 6,402,896 which issued on Jun. 11, 2002. entitled "Roll for a Paper or Board Machine" which is a 371 of PCT/FI98/00942 filed Dec. 3, 1998.

FIELD OF THE INVENTION

The present invention relates to a roll for a paper or board machine, and in particular to a roll of the type having a number of openings extending through the mantle.

BACKGROUND OF THE INVENTION

In paper or board machines, a web forming section employs mainly suction rolls which usually comprise a perforated roll mantle attached to end flanges at the ends of the roll. The end flanges are in turn journalled rotatably on attachment flanges situated at the ends of the roll and attached to the frame of the machine. Inside the roll mantle, there may be a static suction box attached to the attachment flanges enabling suction to be applied to a given sector of the suction roll. The interior of the roll may also be empty, in which case suction is applied to the entire circumference of the roll mantle. The ends of the roll are provided with ducts by which an external source of negative pressure can be connected to the roll. Moreover, bores extending through the roll mantle are normally provided, in the outer surface of the mantle, with countersinks by means of which the unbroken connecting portions surrounding the holes of the bores in the outer surface of the roll mantle are made smaller and the open area of the outer surface of the roll mantle is increased.

The press section of paper or board machines in turn employs rolls which have a roll mantle that is perforated or provided with blinded bores. In that case, the interior of the roll is not necessarily connected to a separate source of negative pressure. In a press nip, water is sucked into the holes, blind-drilled bores or other recesses of the roll mantle and removed from them after the press nip by means of the centrifugal force. In order to reduce the contact pressure, the mantle of press section rolls is normally coated with a material that is softer than steel, for example, with some rubber-like material. The blind-drilled bores in a roll provided with a coated mantle may extend some distance into the steel mantle or merely into the coating depending on a desired volume of the bores. Moreover, both through bores and blind-drilled bores are normally provided with countersinks in the outer surface of the mantle for reducing the size of the unbroken connecting portions that surround the holes or recesses in the outer surface of the roll mantle and for enlarging the open area of the outer surface of the roll mantle.

Around the perforations of the roll mantle on the outer surface of the roll mantle, despite holes, blind-drilled bores or recesses, there remain relatively large unbroken connecting portions at which the suction effect is weaker. For this reason, said unbroken outer surface of the roll mantle causes marking in the paper web.

One solution to his marking problem has been to provide the roll mantle, for example, with a coarse wire net, by which the open surface of the outer face of the roll mantle has been increased. The wire net or a wire sock is mostly made of plastic and it is attached in place by shrinking to form the outermost layer of the roll. The manufacture of such a wire sock and its fitting to the outer face of the roll mantle constitute an additional work stage in the manufacture of the roll. In addition, the wire sock wears in use and thus it has to be replaced at certain intervals.

It is also known to mount on the roll mantle a separate honeycomb arrangement made of metal by means of which the open surface of the outer face of the roll mantle is enlarged. It is difficult to fasten this kind of metal honeycomb to the face of the roll mantle and it may become detached in use.

DE patent 21 40 776 discloses a suction roll of a paper machine comprising a mantle stiffened against bending and a perforation extending through the mantle of the roll and forming a certain pattern. Additionally, the mantle surface of the roll is provided with grooves that connect a row of holes so that a symmetrical embossed pattern of the surface is formed in practice. The hole area in the surface of the roll mantle is over 50% and it may be nearly 90% of the total area of the roll mantle. It is also stated in the publication that some of the above-mentioned holes may be blind-drilled bores or that, in addition to the above-mentioned holes, blind-drilled bores are made into the surface of the mantle for improving the water retention capacity of the roll.

In this arrangement, the connecting surface of the walls between two adjacent grooves in the surface of the mantle forms a solid connecting portion supporting the wire or equivalent.

The problem in this arrangement of DE patent 21 40 776 is the solid connecting portions at which the suction effect of the roll is weaker. These solid connecting portions constitute an obstruction to the free flow of water into the holes or blind-drilled bores.

The arrangement in accordance with the invention provides an essential improvement over the prior art arrangements.

OBJECTS AND SUMMARY OF THE INVENTION

The roll in accordance with the invention provides a very good and even flow of water into the holes extending through the mantle of the roll and/or into the blind-drilled bores and/or equivalent openings situated in the outer surface of the roll mantle. Moreover, in the roll in accordance with the invention, no separate wire sock is needed on the outer surface of the roll mantle. The open area of the outer surface of the mantle of the roll in accordance with the invention is about 70–90% depending on the application.

The arrangement of the invention may be used in a roll of a paper or board machine which comprises either openings extending through the roll mantle, e.g. through bores, or recesses formed into the outer surface of the mantle, e.g. blind-drilled bores, or a combination of them. Such rolls are used, for example, in a web former and in a press section. The invention may be used in a suction roll where suction is applied to the circumference of the entire mantle or in a suction roll having a static suction box by means of which suction is applied to a given sector of the roll. The arrangement in accordance with the invention may also be used in a roll which employs no external source of negative pressure, by which a negative pressure is maintained in the interior of the roll. In that case, the water that is being removed from the web is transferred into the holes and/or blind-drilled bores of the roll mantle at the point of compression by the action of a pressure difference produced in the wire or equivalent supporting the web.

BRIEF DESCRIPTION OF THE DRAWINGS

In the following, the invention will be described in more detail with reference to the figures in the accompanying drawings, to the details of which the invention is, however, not intended to be exclusively confined.

DETAILED DESCRIPTION OF THE INVENTION

Figure 1:
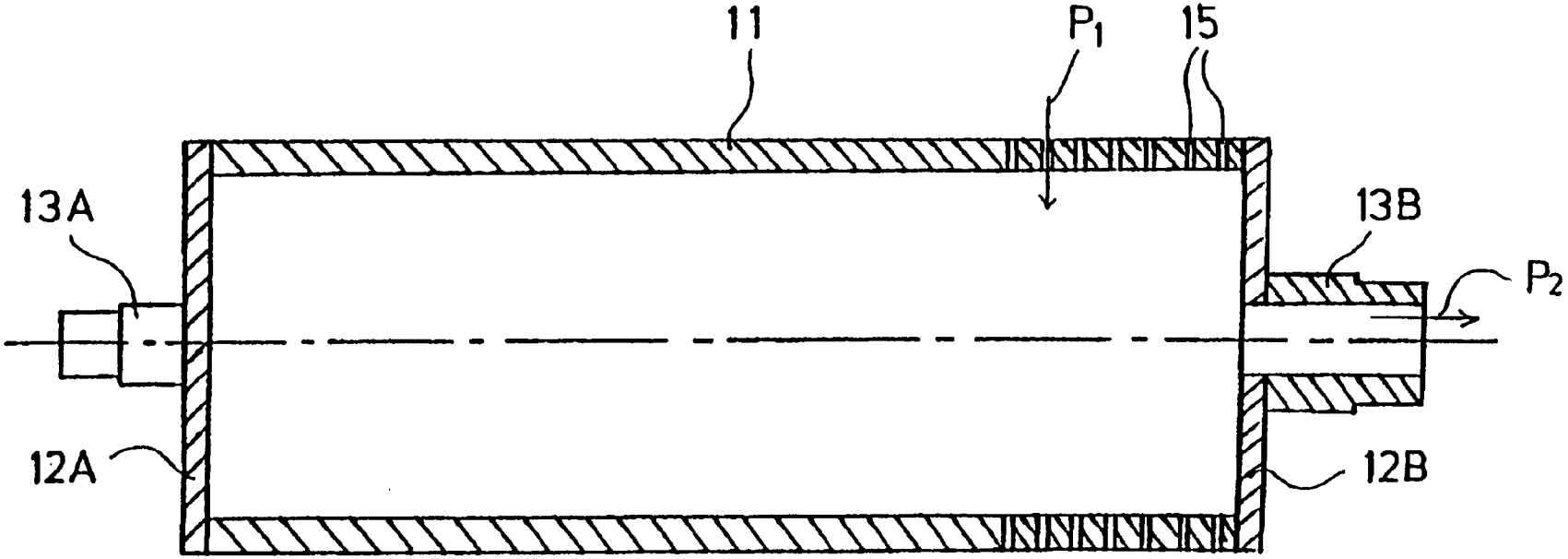
FIG. 1 is a schematic sectional view of a suction roll.

FIG. 1 is a view of principle of a suction roll where the arrangement in accordance with the invention may be used. The suction roll comprises a roll mantle 11, which is rotatably journalled on axle journals 13A and 13B connected to the roll mantle 11 through end flanges 12A and 12B. The roll mantle 11 has perforations 15 which are formed of numerous holes 15 extending through the roll mantle 11. The figure shows only some of the perforations 15 of the mantle 11. The interior of the roll here is empty, but inside the roll there may also be a suction box by means of which suction is guided to a given sector of the roll mantle. At least one 13B of the axle journals comprises ducts which lead to the interior of the roll and to which an external source of negative pressure (not shown in the figure) can be connected. Air is sucked out (arrow P2) by means of the source of negative pressure from the entire interior of the roll or at the sector formed by the suction box, in which connection a corresponding amount of air (arrow P1) flows into the roll through the perforations 15 of the roll mantle. The perforations 15 of the roll mantle 11 may be composed of bores extending with the same diameter through the entire mantle 11 or countersinks may have been made into the bores in the outer surface of the mantle 11, whereby the area of the holes 15 opening into the outer surface of the mantle 11 has been enlarged. The perforations 15 of the roll mantle 11 are advantageously formed to be spiral-shaped so that the holes are not situated in rows in the axial direction of the roll. By this arrangement, the emptying of the holes 15 of water and the subsequent filing of the holes with air can be arranged to take place stepwise in terms of time, whereby the noise caused by this can be reduced. The diameter of the holes 15 is generally about 2–5 mm and the diameter of the countersinks is generally about 2–15 mm.

Figure 2A:
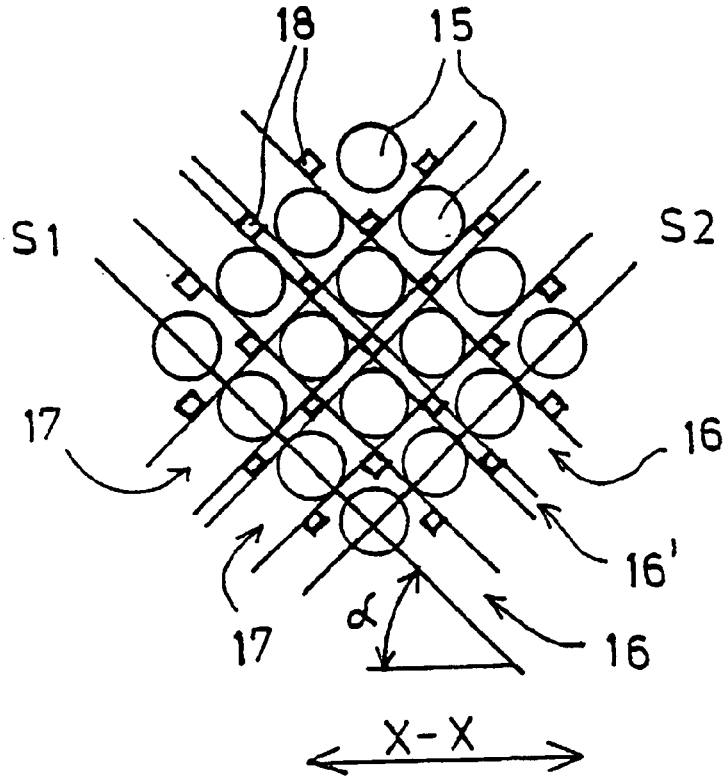
FIG. 2A shows one embodiment of a surface pattern in a mantle of a roll in accordance with the invention.
Figure 4:
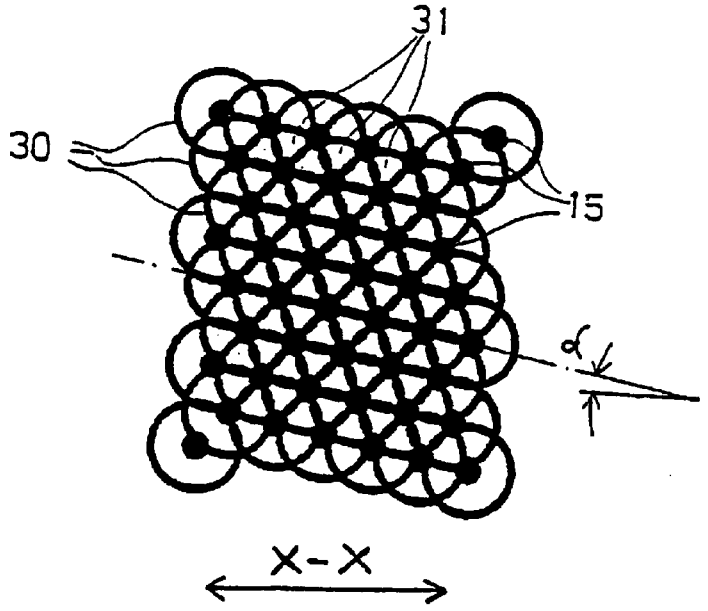
FIG. 4 shows a second embodiment of a surface pattern in a mantle of a roll in accordance with the invention.

FIG. 2A shows one embodiment of a pattern in an outer surface of a mantle of a roll in accordance with the invention. The holes and/or blind-drilled bores or their countersinks 15 situated in the roll mantle form a regular pattern in the outer surface of the roll mantle. Through a line formed by the centres of the holes and/or blind-drilled bores 15, it is possible to draw a curve which extends spirally along the outer surface of the roll mantle and whose angle of spiral relative to the axis X—X of the roll is $\alpha$. In this figure, said angle $\alpha$ is about 45°, but in practical applications the angle of spiral $\alpha$ is, however, considerably smaller than 45 in order that the holes and/or blind-drilled bores 15 shall not be placed in rows parallel to the axis X—X of the roll. In the example of FIG. 4, which shows another embodiment of the invention, the angle of spiral $\alpha$ is about 10°. The arrangement in accordance with the invention may in itself be used at any angle of spiral $\alpha$ and with any regular pattern formed by holes and/or blind-drilled bores.

The row formed by the holes and/or blind-drilled bores 15 in a first direction S1 in FIG. 2A is connected by means of a first groove 16 formed into the outer surface of the roll mantle and the row formed by these holes and/or blind-drilled bores 15 in a second direction S2 is connected by means of a second groove 17 formed into the outer surface of the roll mantle. This figure depicts only two adjacent grooves 16 running in the first direction S1 and two adjacent grooves 17 running in the second direction S2. The width of the crossing grooves 16, 17 in the outer surface of the roll mantle corresponds substantially to the diameter of the holes and/or blind-drilled bores or their countersinks 15 in the outer surface of mantle. When the first grooving 16 is made into the outer surface of the mantle on the holes and/or blind-drilled bores 15, a solid connecting portion 16' is formed between the adjacent grooves 16 in the outer surface of the mantle, which connecting portion prevents a free flow of water into the holes and/or blind-drilled bores 15. This solid connecting portion 16' is broken by means of the second grooving 17 situated crosswise with respect to the first grooving 16 and formed on the holes and/or blind-drilled bores 15. In that case, between four holes and/or blind-drilled bores or their countersinks 15 closest to one another, there remains a square-shaped support point 18 for a wire or an equivalent support member of the web running on the surface of the roll, which support point is situated on a level with the original outer surface of the mantle.

By means of the arrangement shown in FIG. 2A, the open area of the outer surface of the roll mantle can be enlarged at its maximum by about 90% so that only the small square-shaped support points 18 support the wire running on the surface of the roll. From the edges of the square-shaped support points 18, the surface of the mantle inclines into the mantle and opens into the holes and/or blind-drilled bores 15 of the mantle, in which connection the water removed from the web is able to flow freely and evenly into the holes and/or openings of the mantle.

Figure 2B:
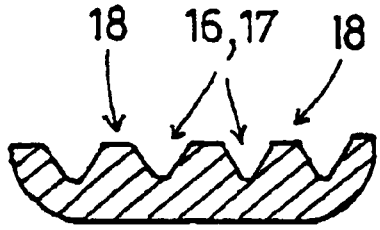
FIG. 2B shows a cross-section of the roll mantle of FIG. 2A.

FIG. 2B shows a cross section of the roll mantle at the support points 18. The cross section shows a profile of the grooves 16, 17 which is advantageously in the shape of a cone widening upwards to the outer surface of the mantle. The support points 18 are depicted here such that their outer surface constitutes a plane, which is the most preferable arrangement from the point of view of the manufacturing technique. In the arrangement that is the most preferable from the point of view of operation, the outer surface of the support points is hemispherical so that the edges of the square-shaped support points will not form a sharp angulation for the wire. The hemispherical surface provides a smooth support surface for the wire moving on the surface of the roll. The depth of the grooves 16, 17 is advantageously about 1.5–2 mm and they may be made into the outer surface of the roil mantle, for example, by turning, milling or knurling.

Figure 3:
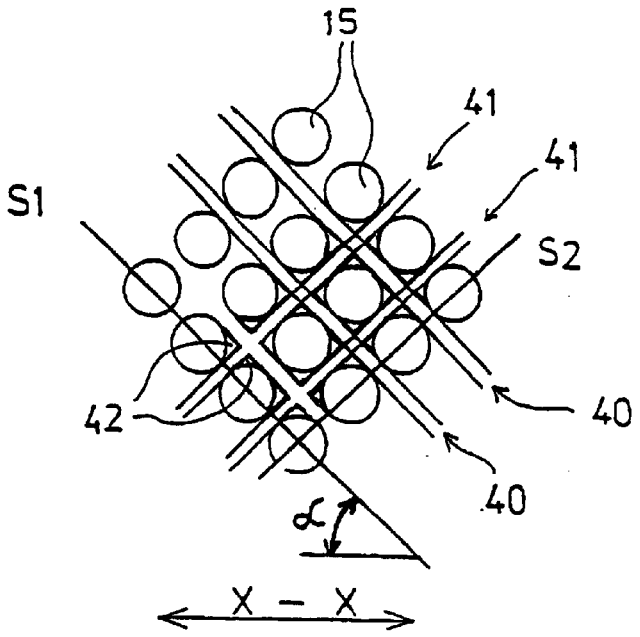
FIG. 3 shows a variant of the embodiment of FIG. 2A.

FIG. 3 shows a variant of the embodiment of FIG. 2A. In FIG. 3, grooves 40, 41 formed in first Si and second S2 directions are provided between rows of holes and/or blind-drilled bores 15 such that the edges of the grooves 40, 41 form a tangent to the holes and/blind-drilled bores or their countersinks 15 in the outer surface of the mantle. In this arrangement, around each hole and/or blind-drilled bore or their countersink 15, there remain, in the outer surface of the mantle, four support points 42 for a wire or an equivalent member supporting the web. The open area of the outer surface of the mantle provided by this embodiment is not as large as that of the embodiment illustrated in FIG. 2A, but in this case, too, water moves relatively efficiently and evenly into the holes and/or blind-drilled bores 15.

FIG. 4 shows a second embodiment of a pattern in an outer surface of a roll mantle in accordance with the invention. The holes and/or blind-drilled bores or their countersinks 15 situated in the roll mantle are shown in the figure as completely filled circles. In addition to the holes and/or blind-drilled bores or their countersinks 15, circular grooves 30 are formed into the outer surface of the roll mantle. The grooves 30 are made such that the centre of each groove 30 coincides with the centre of the holes and/or blind-drilled bores 15 and the centre radius of the grooves 30 is equal to the distance between the centres of the holes and/or blind-drilled bores 15. The centres of the holes and/or blind-drilled bores 15 are situated in this example at the apices of an equilateral triangle. The outer surface of the mantle surrounding the holes and/or blind-drilled bores or their countersinks 15 can be opened by means of said grooves 30. Connecting channels extending to the depth of the grooves 30 are thus formed between the holes and/or blind-drilled bores or their countersinks 15 in the outer surface of the mantle. In this embodiment, the wire or equivalent is supported by triangular support points 31. The open area of the outer surface of the roll mantle can be regulated in this embodiment by regulating the width of the grooves 30. This embodiment, too, provides an efficient flow of water into the holes and/or blind-drilled bores 15.

Figure 5:
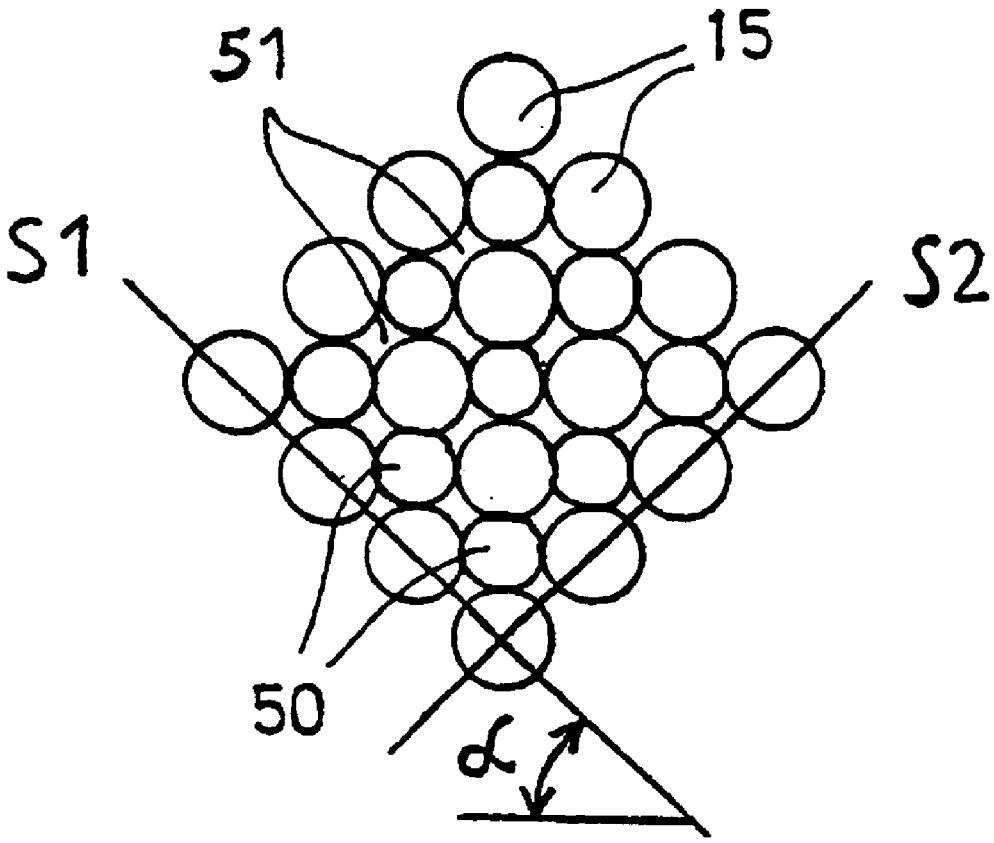
FIG. 5 shows a third embodiment of a surface pattern in a mantle of a roll in accordance with the invention.

FIG. 5 shows a third embodiment of a pattern in an outer surface of a mantle of a roll in accordance with the invention. In this embodiment, blind-drilled bores 50 are provided between holes and/or blind-drilled bores or their countersinks 15 such that each blind-drilled bore opens a connection to the closest holes and/or blind-drilled bores or their countersinks 15 surrounding it. By this means, the open area of the roll mantle can be enlarged. The size of the open area of the outer surface of the mantle depends in this embodiment, among other things, on what kind of pattern the holes and/or blind-drilled bores 15 form in the outer surface of the mantle. If blind-drilled bores 50 are made to the hole pattern shown in FIG. 4, a relatively large open area can be achieved, and if blind-drilled bores 50 are made to the hole pattern shown in FIG. 5, a slightly smaller open area is achieved. The support points supporting the wire are here denoted with the reference numeral 51.

The claims are presented in the following and the details of the invention may vary within the inventive idea of said claims and differ from the disclosure given above by way of example only.

We claim:

1. A roll for dewatering a web in a paper or board machine comprising:

a roll mantle having an outer surface;

a plurality of openings extending at least partially into said outer surface of said roll mantle, each of said openings being spaced from an adjacent one of said openings to define a space there between; and a plurality of recesses formed in the outer surface of said roll mantle for connecting each opening with at least another one opening adjacent to said opening to thereby permit a flow to travel between said openings.

2. The roll according to claim 1, wherein said plurality of recesses comprises a first groove for interconnecting a first group of selected openings of said plurality of openings and a second groove for interconnecting a second group of selected openings of said plurality of openings.

3. The roll according to claim 2, wherein said first groove is structured and arranged to extend in a first direction and said second groove is structured and arranged to extend in a second direction which is orthogonal with respect to said first direction.

4. The roll according to claim 2, further comprising a plurality of support points for supporting a wire, said support points being arranged between adjacent ones of said plurality of openings.

5. The roll according to claim 2, wherein said grooves and said plurality of openings cooperate to define support points arranged in spaces defined between said grooves and said plurality of openings.

6. The roll according to claim 1, wherein said recesses for connecting each opening with at least another one opening adjacent to said opening comprises a plurality of circular grooves arranged in said outer surface, each one of said circular grooves being arranged to encircle a respective one of said plurality of openings and wherein a circular groove encircling one opening is arranged to extend over each adjacent opening.

7. The roll according to claim 1, wherein said recesses for connecting each opening with at least another one opening adjacent to said opening comprises a plurality of blind-drilled bores.

8. The roll according to claim 1, wherein said openings comprises bores extending through said roll mantle.

9. The roll according to claim 1, wherein said openings comprises bores extending through said roll mantle, said bores being provided with countersinks in the outer surface of the roll mantle.

10. The roll according to claim 1, wherein said openings comprises blind-drilled bores extending into the outer surface of said roll mantle.

11. The roll according to claim 1, wherein said openings comprises blind-drilled bores extending into the outer surface of said roll mantle, said blind-drilled bores being provided with countersinks in the outer surface of the roll mantle.

* * * * *